United States Patent [19]

Sakshaug et al.

[11] 4,451,815

[45] May 29, 1984

[54] ZINC OXIDE VARISTOR HAVING REDUCED EDGE CURRENT DENSITY

[75] Inventors: Eugene C. Sakshaug, Lanesborough; James S. Kresge, Pittsfield, both of Mass.

[73] Assignee: General Electric Company, N.Y.

[21] Appl. No.: 423,908

[22] Filed: Sep. 27, 1982

[51] Int. Cl.[3] ..... H01C 7/12

[52] U.S. Cl. ..... 338/21; 361/127

[58] Field of Search ..... 338/21, 20; 361/127; 29/610

[56] References Cited

U.S. PATENT DOCUMENTS 3,863,193 1/1975 Matsuura et al. ..... 338/21 X 4,169,071 9/1979 Eda et al. ..... 338/21 X

FOREIGN PATENT DOCUMENTS 58336 8/1982 European Pat. Off. ..... 338/20

441905 1/1936 United Kingdom ..... 338/21

*Primary Examiner*—C. L. Albritton

*Attorney, Agent, or Firm*—Robert A. Cahill

[57] ABSTRACT

A zinc oxide varistor disc is provided with one or more circumferential recesses in its rim to reduce the current density at the edges of the electrodes on the opposed disc faces, which electrodes are of a lesser diameter than the varistor disc. It has been discovered that optimum results are achieved when the diameter at the bottom of the recess is somewhat less than the diameter of the electrodes.

6 Claims, 6 Drawing Figures

ZINC OXIDE VARISTOR HAVING REDUCED EDGE CURRENT DENSITY

BACKGROUND OF THE INVENTION

The present invention relates generally to voltage surge arresters for high voltage applications and particularly to zinc oxide varistors applicable therein having improved overcurrent withstand.

Zinc oxide varistors, as currently manufactured, comprise a sintered disc of zinc oxide material having a pair of electrodes on opposing faces. The perimeter of the disc is typically covered with an insulating layer of glass or ceramic material to discourage arcing over the surface of the disc perimeter. When the electrodes are applied to the flat faces of the disc, a marginal portion of the disc material in the vicinity of the disc rim is not covered with the electrode material because the physical transition from the flat disc surface to the peripheral rim may not be well defined, and it is important that the electrode material not be applied to any portion of the rim. During varistor operation, current flows directly through the zinc oxide material covered by the electrode material. However, in actuality some current also flows through the zinc oxide material in the vicinity of the rim not covered by electrode material. This current is referred to as "fringing current" and can be a source of failure when the varistor is subjected to overload conditions, i.e. excessive current flow. That is, fringing current causes a disproportionately high current density to occur in the varistor bulk material at the edges of the disc electrodes, as compared to the current density in the central portion of the varistor disc. This high current concentration or density causes excessive electrical stress which can lead to premature disc failure under overload conditions.

The principal object of this invention is to provide a zinc oxide varistor having substantially reduced fringing current-caused current density in the varistor disc adjacent the electrode edges and consequently a greater varistor overload capability.

SUMMARY OF THE INVENTION

Zinc oxide varistors are provided with one or more circumferential grooves formed in the rim of the varistor disc to substantially reduce the detrimental effects of fringing current during varistor operation under overload conditions.

DETAILED DESCRIPTION

Figure 1:
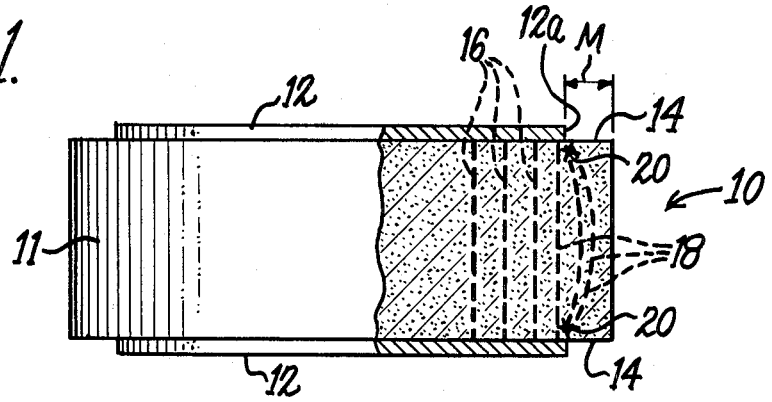
FIG. 1 is a side view of a prior art zinc oxide varistor, partially broken away to diagrammatically represent current flow through the varistor bulk material.

A zinc oxide varistor having a known composition, such as disclosed in U.S. Pat. No. 3,928,245, is generally indicated at 10 in FIG. 1. This varistor comprises a sintered disc-shaped body 11 having electrodes 12 applied to the top and bottom faces thereof. As is common practice, the electrodes do not cover the entire face surfaces. Rather they are terminated short of the disc edges, leaving circumferential marginal portions 14 of the disc faces devoid of electrode material. When the varistor functions to suppress a voltage surge, current flows through the bulk material of disc 11 between the electrodes. Throughout the central region of the disc, the density of this current flow is reasonably uniform, as indicated by the dashed paths indicated at 16. However, at the peripheral edges 12*a* of the electrodes, the current tends to flow in so-called "fringing" paths illustrated by the dashed lines 18. As a consequence of this fringing current effect, localized, particularly high current density regions are created in the varistor material immediately adjacent the electrode edges, as indicated at 20. Due to the undue electrical stress imposed by this high current density condition, a breakdown in the intergranular structure of the varistor material can occur, resulting in varistor failure.

Figure 2:
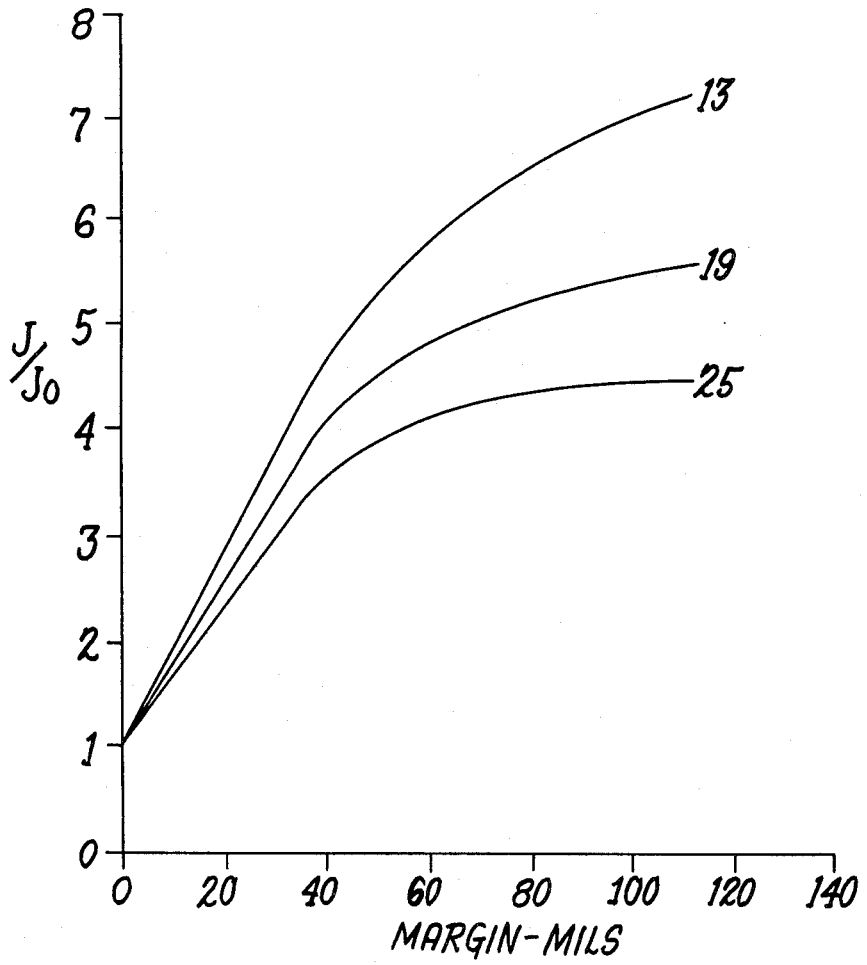
FIG. 2 is a graph depicting current density in the varistor bulk material adjacent the electrode edge of the varistor of FIG. 1 as a function of the marginal separation between the electrode edge and the disc edge.

In FIG. 2 there is illustrated a graph plotting the current density J at region 20 in terms of a ratio with the current density $J_o$ in the central disc region as a function of the width dimension M in mils of the marginal disc surface between the electrode edges 12*a* and the disc edge. Plots are shown for three varistors having different exponents of non-linearity according to the well known varistor current-voltage relationship, expressed as $I=(V/C)^n$. Thus, for the three plots, the three varistor non-linearity exponents "n" are indicated as 13, 19 and 25. From FIG. 2, it is seen that if the marginal dimension M is zero, i.e., the electrode edges coincide with the disc edge, the current density in the varistor material adjacent the electrode edges is equal to the current density in the remainder of the disc. Unfortunately, this configuration is prone to arcing between the electrodes over the rim surface of the disc. As the marginal width M is increased, it is seen that the current density in regions 20 of the disc increases dramatically. At a marginal width of 100 mils, the current density in regions 20 is seven times the current density in the disc central region for a varistor having a non-linearity exponent of 13. For higher exponents, the edge current densities are seen to be less throughout, but still considerably more than in the disc central region. The plots of FIG. 2 were obtained for varistor disc thickness of one and three-eighths inches.

Figure 3:
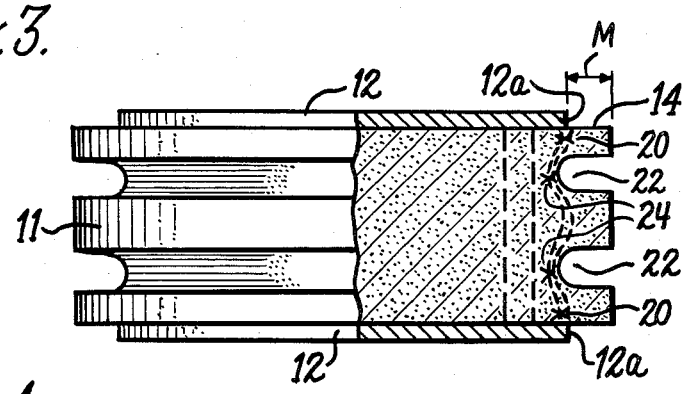
FIG. 3 is a side view of a zinc oxide varistor constructed in accordance with one embodiment of the invention, partially broken away to diagrammatically represent current flow through the varistor bulk material.

In accordance with the present invention, edge current density in the regions 20 of the varistor disc immediately adjacent the electrode edges 12*a* is significantly reduced by creating a pair of circumferential grooves 22 in the rim of the disc, as seen in FIG. 3. However, with the presence of these grooves, it is found that second localized, high current density regions are created in the varistor bulk material adjacent the bottoms of the grooves, as indicated at 24. It thus becomes necessary to develop a compromise geometry which minimizes the current densities at these critical locations. To this end, plots of the relative current densities at locations 20 and 24 versus margin width M are developed in FIG. 4 for three varistors comparable to the three plotted in FIG. 2 except for the presence of the grooves 22. The disc is again 1⅜ inches thick, and the grooves are 113 mils deep and spaced ¼ inch from faces of the disc, measured from their respective upper and lower edges. The three plots commonly indicated at A are of the current densities at location 20, while the three plots indicated at B are of the current densities at location 24. Again the edge current densities are ratioed with the current densities in the central disc region.

Figure 4:
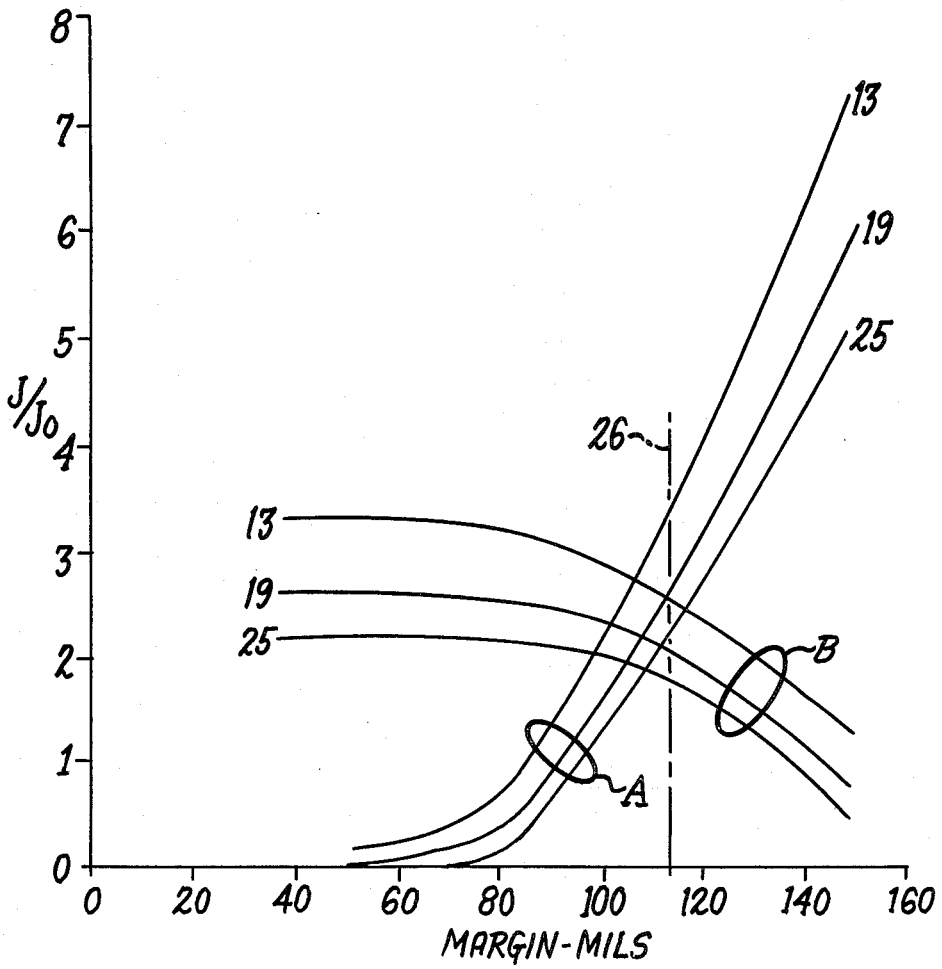
FIG. 4 is a graph depicting current density in the varistor bulk material of the varistor of FIG. 3 at two critical locations as a function of the marginal separation between the edges of the electrode and disc.

From plots A, it is seen that, as in FIG. 2, as the margin width is increased, so is the current density at location 20, except that, by virtue of grooves 22, the current density does not begin increasing significantly until the marginal width M exceeds 80 mils. Less than that, the current density at location 20 is significantly less than the current density in the central disc region. In fact, the current density adjacent the electrode edges is virtually negligible when the electrodes extend out to within 50 mils of the disc edge. On the other hand, however, plots B indicate that the current densities at locations 24 start out high and begin decreasing as the margin width is increased beyond 80 mils. Thus, the optimum marginal widths M are those dimensions where the corresponding varistor plots of the families A and B cross, which are seen to be in the range of 103 to 110 mils. As indicated by these intersections, the edge current densities at locations 20 are less than 50% of that shown in FIG. 2 for the prior art configuration of FIG. 1. Since vertical line 26 in FIG. 4 represents the 113 mil groove depth, it is seen that the optimum configuration calls for the grooves 22 to extend inwardly to depths slightly beyond the electrode edges 12*a*. It is to be noted that the grooves 22 are shown preferably located in more closely spaced relation to the disc faces than to each other. While the data for the plots in FIG. 4 were generated for one particular groove depth, there is nothing to indicate that the abovenoted optimum relationship of groove depth to marginal width would not hold true for different groove depths.

Figure 5:
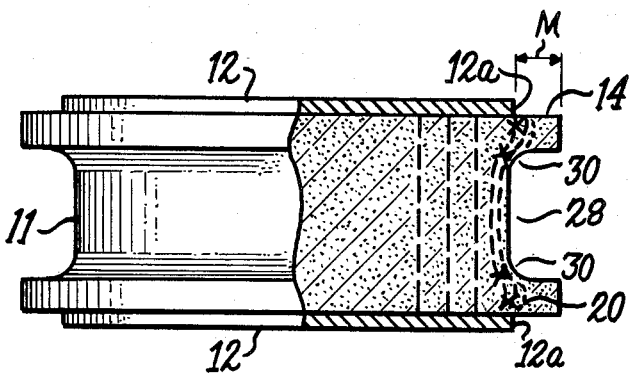
FIG. 5 is a side view of a zinc oxide varistor constructed in accordance with another embodiment of the invention, partially broken away to diagrammatically represent current flow through the varistor bulk material.
Figure 6:
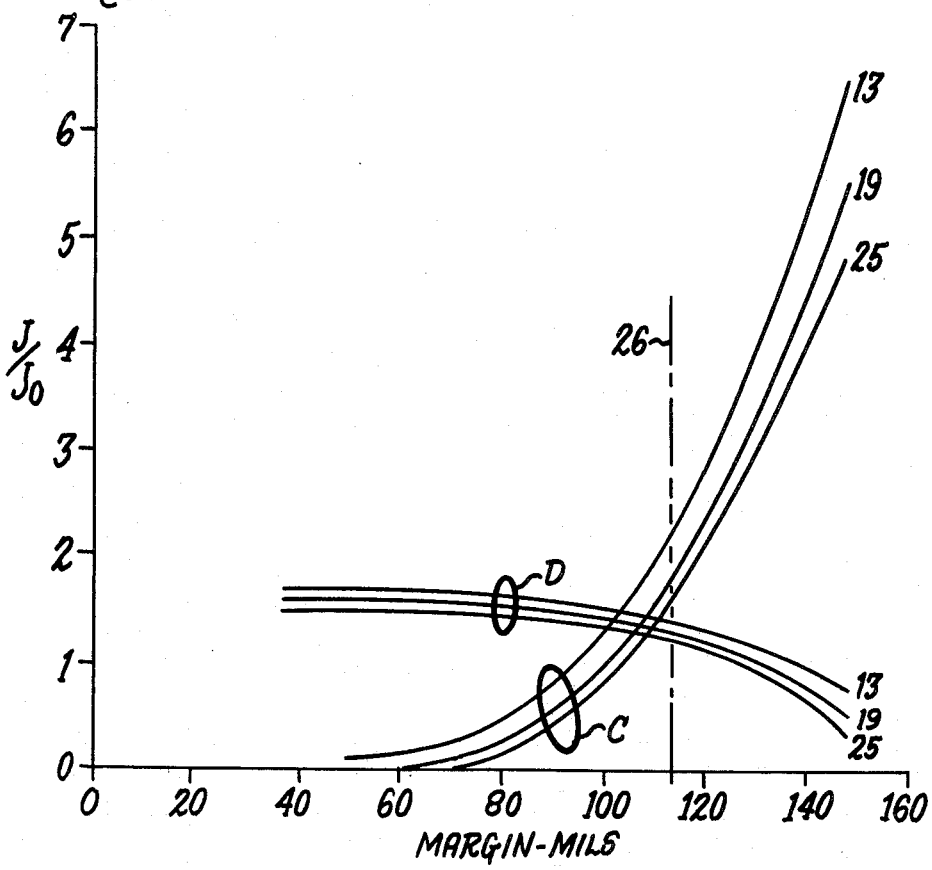
FIG. 6 is a graph depicting current density in the varistor bulk material of the varistor of FIG. 5 at two critical locations as a function of the marginal separation between the edges of the electrode and disc.

According to an alternative embodiment of the invention seen in FIG. 5, the rim of the varistor disc 11 is provided with a single wide circumferential groove 28, rather than the two narrow grooves 22 of FIG. 3. Groove 28 is 113 mils deep, with its upper and lower edges spaced ¼ inch from the disc faces. In other words, the varistor disc configuration of FIG. 5 would be the same as that in FIG. 3 if the varistor disc material separating grooves 22 were removed. Thus, the width of groove 28 is greater than 50% of the height of the rim. In addition to the critical edge current density locations 20 adjacent to electrode edges 12*a*, there are critical locations in the configuration of FIG. 5 adjacent the rounded inner corners of groove 20, as indicated at 30. Looking at the current density plots of FIG. 6 for the single wide groove configuration of FIG. 5, it is seen that the critical location current densities versus marginal width M vary in the same manner as in FIG. 3, but are lower in magnitudes throughout. The intersections of the plots C for location 20 and plots D for location 30 in the varistor disc of FIG. 5 are seen to indicate again that the optimum relationship of groove depth and marginal width is achieved when the groove extends inwardly to a depth, represented at 26 in FIG. 6, lying somewhat beyond the electrode edges. That is, the electrodes 12 should overlap the groove bottom by a distance up to approximately 10 mils. The rather exaggerated width of groove 28 was found to be an important consideration since studies shows that a single narrow groove located midway between the disc faces was less effective even as compared to the dual groove configuration of FIG. 3.

It will thus be seen that the general object set forth above, as well as those made apparent from the preceding description, are effeciently attained and, since certain changes may be made in the above constructions without departing from the scope of the invention, it is intended that all matters contained in the above description or shown in the accompanying drawings shall be interpreted as illustrative and not in a limiting sense.

Having described the invention, what is claimed and desired to secure by Letters Patent is:

1. A zinc oxide varistor comprising:

a disc-shaped sintered body having opposed faces and circumferential rim;

an electrode applied to each said face, the edges of said electrodes being spaced from the edges of said body to leave circumferential marginal portions of said faces devoid of electrode material; and at least one circumferential groove created in said rim, the depth of said groove being approximately equal to the width of said electrode-free marginal face portions.

2. The zinc oxide varistor defined in claim 1, wherein said rim is provided with a pair of circumferential grooves.

3. The zinc oxide varistor defined in claim 2, wherein the spacing between said grooves is greater than the spacing between each said groove and the face of said body most adjacent thereto.

4. The zinc oxide varistor defined in claim 1, wherein said rim is provided with a single wide groove, the width of said single groove being in excess of 50% of the height of said rim.

5. The zinc oxide varistor defined in claims 1, 2, 3, or 4, wherein the groove depth is somewhat in excess of the width of said electrode-free marginal width portions.

6. A zinc oxide varistor comprising:

a disc-shaped body having opposed faces and a circumferential rim;

an electrode applied to each said face, the edges of said electrodes being spaced from the edges of said body to leave electrode-free circumferential marginal portions of said faces; and at least one circumferential groove created in said rim, the depth of said groove being at least equal to the width of said marginal face portions such as to limit the overload current densities in the portions of said body located adjacent the electrode edges and the bottom of said groove to tolerable levels.

* * * * *